United States Patent [19]

Neufeld

[11] 4,233,775

[45] Nov. 18, 1980

[54] SOFT TOYS

[75] Inventor: Anthony C. Neufeld, London, England

[73] Assignee: Newfeld Limited, Ashford, England

[21] Appl. No.: 964,518

[22] Filed: Nov. 29, 1978

[51] Int. Cl.[3] ..... A63H 3/04

[52] U.S. Cl. ..... 46/151; 46/158; 46/162

[58] Field of Search ..... 46/162, 163, 164, 151, 46/158

[56] References Cited

U.S. PATENT DOCUMENTS

| | | | |
|---|---|---|---|
| 2,451,023 | 10/1948 | Dusho | 46/163 |
| 3,032,922 | 5/1962 | Mitchell | 46/162 |
| 3,807,086 | 4/1974 | Schleich | 46/162 |
| 3,830,898 | 8/1974 | Johnson et al. | 46/162 |
| 3,955,309 | 5/1976 | Nobel | 46/162 |
| 4,123,872 | 11/1978 | Silva | 46/151 |

FOREIGN PATENT DOCUMENTS

| | | | |
|---|---|---|---|
| 464992 | 11/1935 | United Kingdom | 46/162 |
| 984694 | 3/1965 | United Kingdom | 46/151 |

*Primary Examiner*—Jay N. Eskovitz
*Attorney, Agent, or Firm*—Alexis Barron

[57] ABSTRACT

A soft toy for children, and comprising a wire skeleton covered with a foamed latex material to define a body having a torso, four limb portions and a neck portion. A fabric covering fits over the foamed latex body and defines hand and foot members to be disposed at the ends of the respective limb portions and a head member which fits over the neck portion. The hand, foot and head members are stuffed for instance with synthetic foam chippings so as to take up an appropriate shape defined by the fabric covering.

10 Claims, 3 Drawing Figures

SOFT TOYS

BACKGROUND OF THE INVENTION (a) Field of the Invention

This invention relates to soft toys, and in particular to soft toys having a generally humanoid or animal-like form, intended as playthings for children.

(b) Description of the Prior Art

One known method for making animal-like or human-like soft toys for children, which has been practised for many years, is to mould a foamed natural or synthetic rubber latex material over a relatively stiff but flexible wire frame or skeleton. The mould for the foamed latex material may take any desired form, but typically includes a torso portion, arm and leg portions and a head portion, the arm and leg portions respectively including hand and foot sections, or paw sections, as required. The completed toy is then generally soft to the touch, by virtue of the resilient characteristics of the foamed natural or synthetic rubber latex material, and yet may be deformed to take up a required attitude. The toy moreover tends to remain in such an attitude, by virtue of the wire skeleton. Soft toys manufactured by this process are usually finished by painting directly on the outer surface of the formed natural or synthetic rubber latex material and of course the toys may be dressed with clothing if required.

It is a disadvantage of the above known manufacturing method for soft toys that the production of appropriate moulds for the foamed natural or synthetic rubber latex material is a skilled, time consuming task, and is thus very expensive. If a manufacturer wishes to produce a range of animal- or human-like soft toys all generally similar but having different characteristics—for instance, soft toys of generally the same size and shape but having different facial characteristics such as the face of a human, the face of a rabbit, the face of a dog and so on—a separate mould is required for each toy in the range. Moreover, if it is desired slightly to change a design, often a completely new mould must be produced. A further disadvantage of the known method described above is that the painting on the foamed material to finish the toy has to be done by hand, and a labour-intensive process such as this is very expensive to perform in the climate of the modern toy-making industry.

OBJECTS OF THE INVENTION

It is a principal object of this invention to produce a soft toy having a body of a foamed latex material, but which allows the production of a range of similar toys without all the attendant disadvantages of the known processes discussed above. In particular, it is an object of this invention to provide a soft toy which may be finished to have different facial characteristics without the need to produce a separate mould for each design.

A further object is to provide a soft toy which is relatively easy to manufacture and which does not require labour-intensive finishing, such as painting by hand. A soft toy of this invention is thus relatively cheap to manufacture, as compared to the known hand-painted foamed-latex designs.

Yet another object of this invention is to provide a soft toy which has safety advantages over the known designs of toys having a wire skeleton covered with foamed latex, insofar as in the toy of this invention, at the ends of the limbs of the toy, the wire skeleton is prevented from penetrating the exterior skin of the foamed latex in the event of abuse of the toy.

SUMMARY OF THE INVENTION

In accordance with the foregoing objects, this invention provides a soft toy comprising a body and a fabric covering, said body having a torso, four limb portions and a neck portion all of which portions and the torso consist of a foamed natural or synthetic rubber latex material moulded over a flexible wire skeleton, and said fabric covering being permanently fitted over said body and including hand and foot members at the respective ends of said limb portions and a shaped head member which fits over said neck portion, the hand, foot and head members each being stuffed with a stuffing material whereby the hand, foot and head members hold a desired, pre-formed shape dictated by the fabric covering.

It will be appreciated that with the toy of this invention, a single body consisting of foamed natural or synthetic rubber latex material moulded over a wire skeleton, may be used to produce a range of soft toys of essentially the same nature but of different characteristics so far as the head, foot and hand members are concerned. Thus, the head member may be cut and stitched from fabric to be a facsimile of a human head or different forms of animal head, or charicatures thereof, after the stitched fabric has been stuffed with an appropriate stuffing material. In a similar way, the fabric may be cut and stitched to form the hand and foot members, when stuffed with a stuffing material, to be of a desired shape appropriate for instance for the form of head being used, or indeed any other desired shape and form. For example, the 'hand' and 'foot' members may be in the form of similar paws.

BRIEF DESCRIPTION OF THE DRAWINGS

A soft toy arranged in accordance with this invention is described hereinbelow, referring to the accompanying drawings, and is described only by way of example of this invention. In the drawings.

DESCRIPTION OF THE PREFERRED EMBODIMENTS

Figure 1:
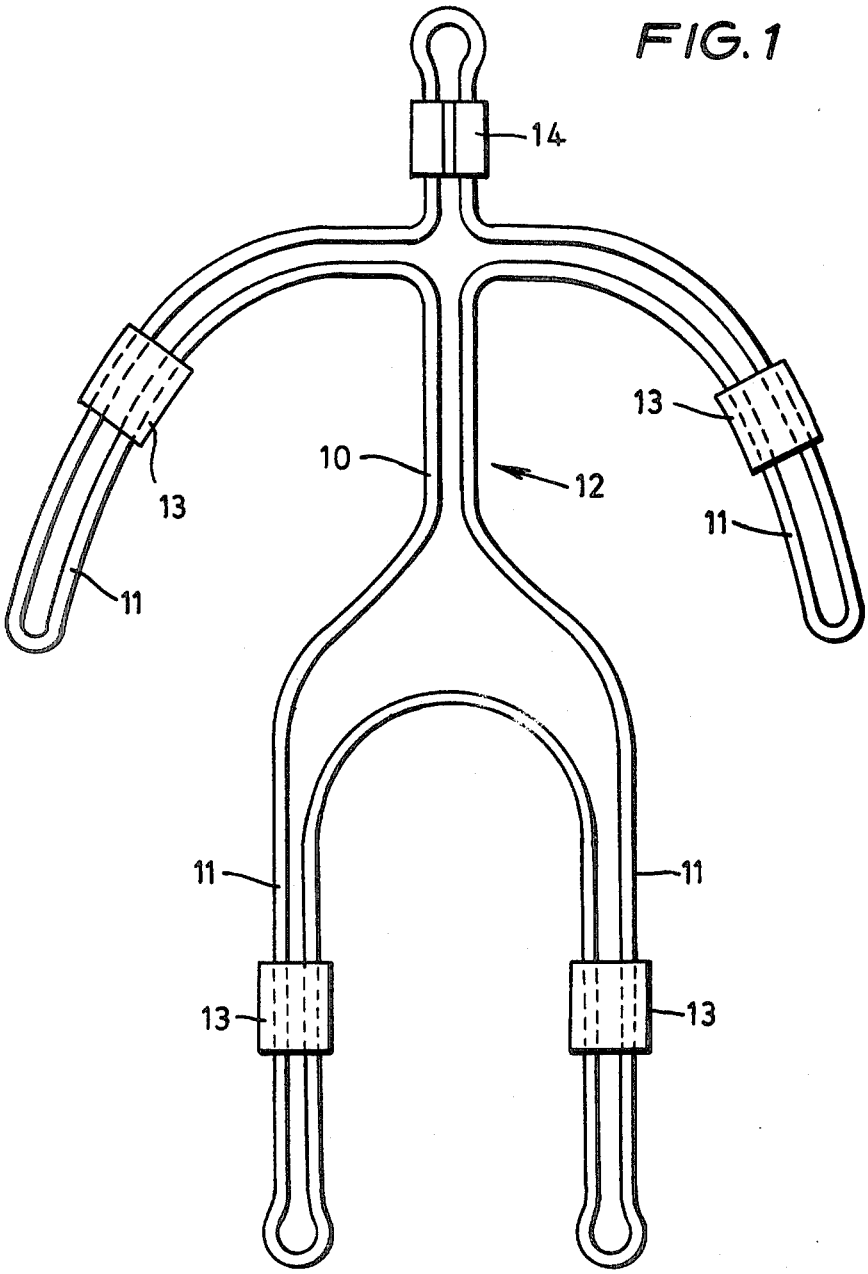
FIG. 1 is a diagram showing a wire skeleton for a soft toy of this invention.

Various preferred aspects of this invention will now be described, as well as said specific embodiment which incorporates many of the various preferred aspects.

The fabric covering for the body need not be made all of the one and same fabric. For instance, different fabrics may be cut and stitched together to provide "clothes" of different colours—for instance, "trousers" for the lower regions and leg (or hind leg) limb portions of the body and a "shirt" for the upper region and arm (or fore-leg) limb portions of the body.

The hand and foot members may be formed from the same fabric as the covering for the immediately adjacent limb portions, though it is preferred to provide the covering for said hand and foot members from a different fabric, either different in colour alone or possibly different in texture as well as colour and stitched to the fabric covering the adjacent limb portions. Similarly, said head member may be formed from a different fabric from that of the torso covering, either in colour alone or possibly in texture also and stitched to the fabric of the torso covering. Especially for the head member, a plurality of different materials may be used to define different parts of the member. It is particularly preferred to employ relatively smooth fabric coverings for the torso and limb portions, whereas the hand, foot and head members are advantageously of a softer, pile fabric. Nevertheless, for soft toys having an animal-like head portion, it is preferred for at least the head member to be of a long pile fabric—typically, a fur fabric—and of course the body may also have a fabric covering of a fur fabric if desired.

To add to the attraction of the soft toy, preferably said head member has added decoration, so as to represent more closely a humanoid or animal face. For instance, glass, moulded plastics or fabric eyes may be attached to the head member at appropriate points, as well as representations of a nose and mouth. By appropriate shaping of these elements, the finished soft toy may convey the impression of a particular "mood", such as happiness.

It is also preferred for said head member to have attached thereto further pieces of fabric to represent ears, especially when the head member is shaped to have the form of an animal normally associated with large ears, such as a dog's head or rabbit's head.

In the above-mentioned prior art processes for making soft toys by moulding latex foam over a wire skeleton, the foamed natural or synthetic rubber latex material must be of a relatively high density to give the finished toy sufficient resistance to tearing, such as the toy might encounter when in use. By covering the toy with a fabric in accordance with this invention, the fabric adds greatly to the strength of the toy, and protects the foamed latex body. Thus, there is the possibility of using a relatively low density foamed natural or synthetic rubber latex material, leading to a lighter toy which is more economic to produce, more easily deformable and softer to the touch.

The wire skeleton is preferably of aluminium wire and conveniently is coated with a plastics material. Advantageously the skeleton is formed from one continuous length of wire, the two free ends being arranged to lie side-by-side, a plastics clip coupling and protecting the two free ends. Plastics clips may also be provided to hold together two portions of the wire skeleton where runs of the wire lie side-by-side. Such a skeleton is found to be entirely safe in use, even if the fabric covering of the toy as well as the foamed latex material itself should be handled so roughly as to be ruptured.

The fabric covering preferably loosely fits over at least the limb portions of the body and advantageously over the torso as well, in a generally similar manner to clothes for humans, but is permanently arranged—for instance by sewing all the covering parts together—so as to prevent removal of the covering. Such a loose fabric covering allows the body to be deformed as required without placing strains on the fabric covering or on the foam body. There is also the advantage of greater realism for certain designs, as compared to conventional soft toy manufacturing techniques, as well as the possibility of making a relatively large toy but employing less stuffing material than conventionally has been used.

Referring now to the accompanying drawings, in FIG. 1 there is shown a pre-formed wire skeleton for use in producing a foamed natural or synthetic rubber latex body. The wire 10 is of annealed, high-purity aluminium and is covered with polyvinylchloride (PVC); a single strand is bent and shaped to provide two runs in each of the four limb portions 11 and in the spine portion 12. Moulded plastics clips 13 hold the runs together in each limb portion 11, and glued on to the two ends of the wire 10 is a moulded plastics cap 14. The wire is relatively soft and can be bent a great number of times without suffering from fatigue. The PVC covering on the wire, the clips 13 and cap 14 make the toy safer, should the fabric covering and foamed body (both described below) become torn. The adhesive used to hold the cap 14 on to the free ends of the wire should be selected to form a permanent bond with the PVC covering, and this is an important safety feature since it positively prevents the possible exposure of the ends of the wire. At the ends of the limbs, the wire is rounded between the turns of the wire, and again sharp ends are avoided.

Figure 2:
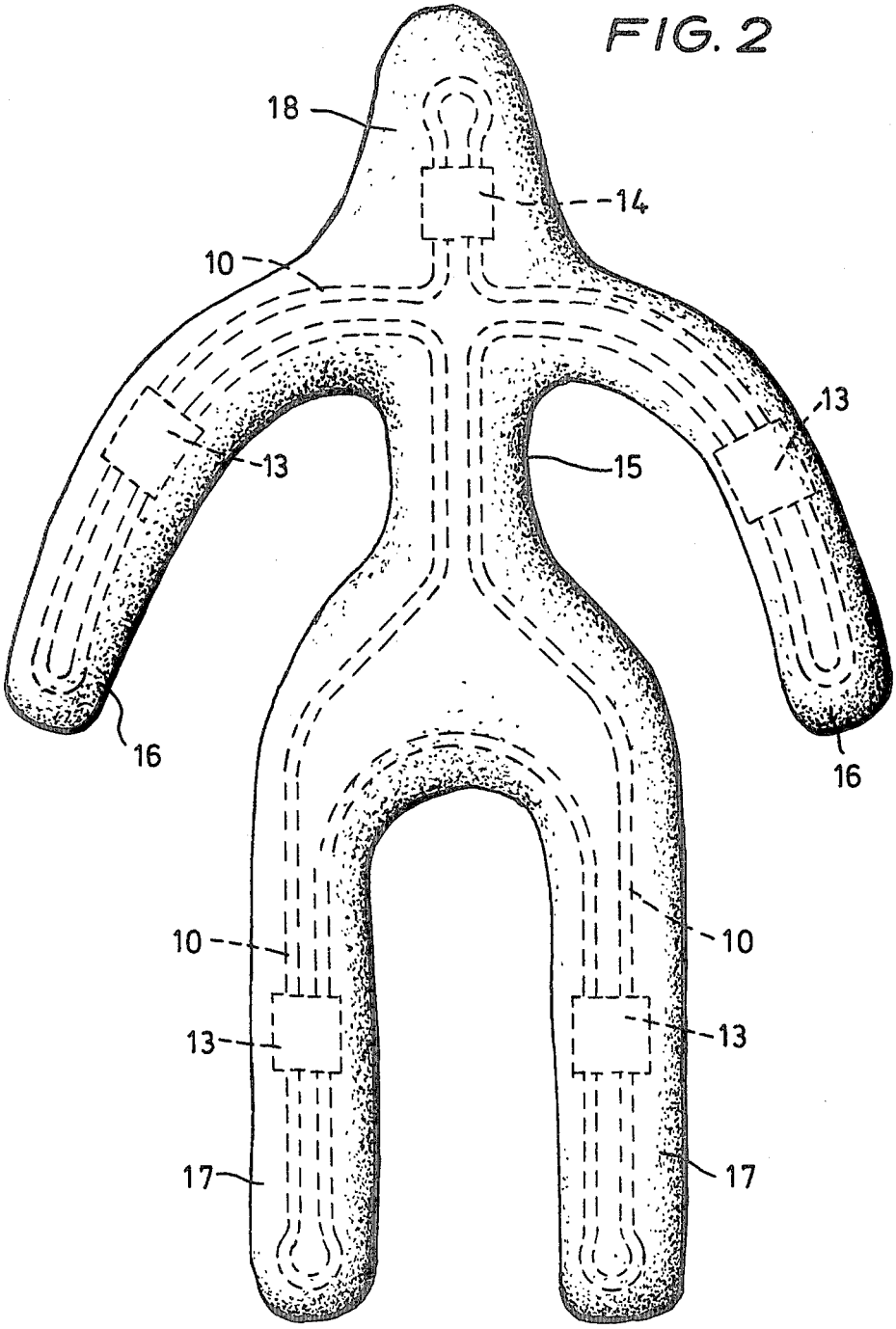
FIG. 2 is a perspective view of a body for use in the soft toy.

FIG. 2 of the drawings shows a completed body utilising the wire skeleton of FIG. 1. The body comprises a torso 15 having four limb portions, in the form of two arms 16 and two legs 17, depending therefrom. Projecting from the torso 15 adjacent the two arms 16 is a neck portion 18. The body is formed from foamed natural or synthetic rubber latex moulded around the wire skeleton, the moulding of the foamed material and appropriate grades of such material being well known and understood in the art and will not be described in detail here.

Figure 3:
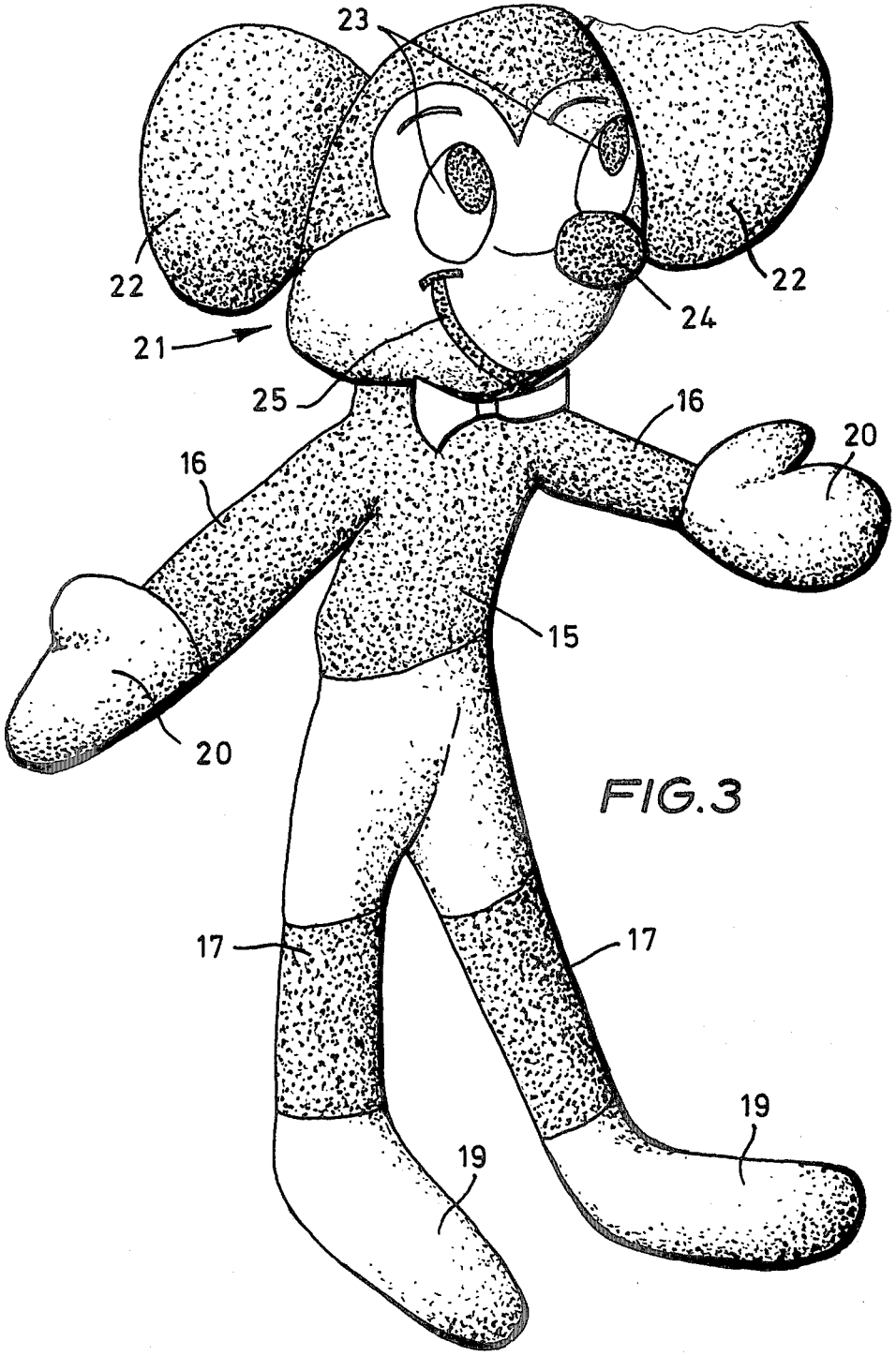
FIG. 3 is a perspective view of a completed soft toy constructed in accordance with this invention.

Referring now to FIG. 3, there is shown a completed soft toy of this invention, which employs a body as shown in FIG. 2. As can be seen from FIG. 3, the body of FIG. 2 has been covered with fabric suitably cut and stitched to fit loosely but permanently on the body. A first material is used to cover the arms 16 and upper portion of the torso 15, so as generally to represent a shirt, and a second material is used to cover the lower portion of the torso 15 and the legs 17, so as generally to represent trousers. Stitched to the lower end of each trouser leg respectively is a further fabric material pre-shaped, sewn and stuffed with a relatively firm but resilient material so as generally to take the form of a foot 19. In a similar way, stitched to the free end of each arm of the shirt are pieces of fabric pre-shaped by cutting and sewing and then stuffed with a relatively firm but resilient material so as to represent a hand 20. The moulded foam material of the body is arranged to press on the material used for stuffing the hands and feet generally in the region of the 'wrists' and 'ankles' respectively, so that the hands and feet may be moved relative to the body without unduly straining the foamed natural or synthetic rubber latex material of the body. Moreover, the stuffed hands and feet prevent end-loads being imparted to the foamed latex limbs, and in turn this reduces the probability of the wires penetrating the ends of the latex body.

Also stitched to the shirt is a head 21, formed by cutting fabric in an appropriate manner and stitching the pieces together, the cut and stitched fabric then being stuffed with a relatively firm but resilient material.

As can be seen from the drawing, by appropriate cutting, stitching and stuffing, the head 21 may take the form of a stylised animal's head—in this case a stylised dog's head. The effect of the head 21 is enhanced by attaching thereto further fabric portions to represent ears 22, eyes 23, and a nose 24 and mouth 25. The neck portion 18 of the body is arranged to project into the head, in a recess in the stuffing thereof, so that the head portion is relatively firmly attached to the body and does not tend to flop to one side or another relative to the body when the soft toy is held in the normal, upright attitude.

It will be appreciated that the fabric material used for covering the various portions of the body as well as for forming the hands, feet and head may be the same or may be different, so far as texture or colour are concerned. It is in fact preferred to use at least materials of contrasting colours, and advantageously different surface finishes on the fabrics are also used. In a preferred arrangement, the head portion and hands are made from a nylon fur fabric, whereas the shirt, trousers and feet are made from a brushed nylon fabric. By employing such materials, the overall soft toy may be washed, should it become soiled.

The stuffing for the head, hands and feet preferably comprises synthetic foam chippings, which will permit the washing of the completed article, should it become soiled. Clearly, by stuffing the head portion, hands and feet to different degrees, and by employing suitable grades of foam chippings, the said portions may be given any required degree of resilience.

It will be appreciated that other forms of head may be stiched to the shirt, and indeed differently shaped hands and feet may be stitched to the shirt and trousers respectively. In this way, a range of generally similar soft toys but of different characters may be produced all employing the same basic body but merely covered with differently formed fabrics. In this way, a range of soft toys may be produced at considerably less cost than if separate moulds were to be produced for each member of the range.

I claim:

1. A soft toy comprising a body and a fabric covering, said body having a torso, four limb portions and a neck portion all of which portions and the torso consisting essentially of a foamed rubber latex material moulded over a flexible wire skeleton which skeleton is formed from a single length of annealed wire covered with a plastics material, and said fabric covering is permanently fitted over said body and includes hand and foot members at the respective ends of said limb portions and a shaped head member which fits over said neck portion, the hand, foot and head members being stuffed with a stuffing material whereby the hand, foot and head members hold a desired, pre-formed shape dictated by the fabric covering.

2. A soft toy as claimed in claim 1, in which the wire forming the skeleton is annealed aluminium wire and said plastics material covering the wire is polyvinylchloride.

3. A soft toy as claimed in claim 2, wherein the two free ends of the single length of wire forming the skeleton lie adjacent one another and a plastics material clip is disposed to cover and hold together said two free ends of the wire.

4. A soft toy as claimed in claim 1, in which the fabric covering for the body is made up from a plurality of distinct fabrics stitched together.

5. A soft toy as claimed in claim 4, in which a relatively smooth fabric is used for covering said torso and limb portions whereas said hand, foot and head members are covered with a relatively soft, long-pile fabric.

6. A soft toy as claimed in claim 5, in which said head member is covered with a fur fabric.

7. A soft toy as claimed in claim 6, in which synthetic foam chippings are used to stuff said hand, foot and head members.

8. A soft toy as claimed in claim 1, in which decorations resembling facial features are attached to the head member.

9. A soft toy as claimed in claim 1, in which synthetic foam chippings are used to stuff said hand, foot and head members.

10. A soft toy according to claim 1, 2, 3, 4, 5, 6, 7, 8 or 9 wherein said wire is covered throughout its length, including the ends thereof, with said plastics material, and wherein said hand, foot, and head members are non-detachable.

* * * * *